US005967384A

United States Patent [19]

Mengeu et al.

[11] Patent Number: 5,967,384

[45] Date of Patent: Oct. 19, 1999

[54] TWO-PIECE, FLIP-TOP CLOSURE

[75] Inventors: Gary L. Mengeu, Wheeling, W. Va.; Victor T. Exner, Bellaire, Ohio

[73] Assignee: RXI Plastics, Inc., Triadelphia, W. Va.

[21] Appl. No.: 08/883,730

[22] Filed: Jun. 27, 1997

[51] Int. Cl.[6] ..... B67D 3/00

[52] U.S. Cl. ..... 222/517; 222/556; 222/563

[58] Field of Search ..... 222/517, 556, 222/563; 220/254, 335

[56] References Cited

U.S. PATENT DOCUMENTS

| | | | |
|---|---|---|---|
| 4,358,032 | 11/1982 | Libit | 222/498 |
| 4,625,898 | 12/1986 | Hazard | 222/517 |
| 4,700,858 | 10/1987 | Bennett | 215/237 |
| 4,711,372 | 12/1987 | Gach | 220/254 |
| 4,881,668 | 11/1989 | Kitterman et al. | 222/482 |
| 5,065,911 | 11/1991 | Rohr et al. | 222/556 |
| 5,219,100 | 6/1993 | Beck et al. | 222/480 |
| 5,271,536 | 12/1993 | Wilson | 222/498 |
| 5,358,130 | 10/1994 | Mengeu | 215/238 |
| 5,782,388 | 7/1998 | De Nervo | 222/556 |
| 5,785,209 | 7/1998 | Guglielmini | 222/556 |

*Primary Examiner*—Joseph A. Kaufman
*Attorney, Agent, or Firm*—Richard V. Westerhoff; Eckert Seamans Cherin & Mellott, LLC

[57] ABSTRACT

A dispensing closure is molded as a base having an end wall with a dispensing orifice and a lid having a fixed section and a moveable section joined by an integral hinge. The fixed section of the lid is mounted on the base by a socket and plug connection in which the socket includes a central prong and the plug has a central recess. The socket and plug are sized for an interference fit, but with chamfered edges providing a lead in. In addition, the recess in the plug is tapered at a greater angle than the prong in the socket, so that as the plug engages the socket and the prong enters the recess in the plug, the plug is wedged outward into tight engagement with the socket. Extensions or wings on the moveable section of the lid created by offset of the integral hinge have inwardly projecting knobs which cooperate with outwardly projecting ribs on the raised member on the bare end wall in which the socket is formed.

19 Claims, 6 Drawing Sheets

TWO-PIECE, FLIP-TOP CLOSURE

BACKGROUND OF THE INVENTION

1. Field of the Invention

This invention relates to closures for dispensing contents from a container and, more particularly, to such closures having a lid which plugs the dispensing opening when not in use and which is biased open to prevent interference with dispensing of product during use.

2. Background Information

A common type of closure for dispensing liquid, granular or viscous product from a container includes a base which screws onto the container neck and has a dispensing opening smaller than the container opening in an end wall. In order to plug the dispensing opening between uses, a stopper is provided on a lid which is hinged to pivot between a closed position with the stopper plugging the dispenser opening and an open position with the stopper removed. The lid may be a separate piece pivotally mounted on the base by a hinge. More often, the lid is connected to a support piece by an integral hinge with the support piece secured to the base. The entire closure can be molded as a single piece with the support piece tied to the base by another integral hinge or hinges, or the support piece and lid can be molded separately from the base. In either case, the support piece is fixed in place on the base by a snap connection. Typically, the snap connection is made by a pin with an enlarged head which projects through and is captured in an opening through the end wall, by nipples (sometimes hollow) which engage a recess, or by friction fit of a projection into a slot.

As the container is tilted or even inverted in order to dispense the product, various arrangements are provided to prevent interference of the pivoted lid with product flow. In some such closures, a portion of a skirt on the lid is engaged to hold the lid open. In other such closures, tabs extending in the plane of the lid bear against the end wall of the base or engage recesses in the base as the lid rotates over center.

In designing such closures, consideration must be given to ease of manufacture assembly and use, reliability and, of course, cost. There is room for improvement in all of these areas.

SUMMARY OF THE INVENTION

The present invention is an improved two-piece, flip-top closure which includes a base having a dispensing opening in an end wall, and a lid having a fixed section and a moveable section connected by an integral hinge. Mounting means for securing the lid to the base member comprise a socket in either the base member or the fixed section of the lid and a plug on the other. Preferably, the socket is molded into a raised member provided on the end wall of the base and the plug projects downwardly from the fixed section of the lid.

The socket has a prong which engages a recess in the plug. The prong and recess are configured to wedge the plug outward into engagement with the socket as the plug is inserted into the socket. This provides a very secure connection between the base member and the lid which can withstand the typically rough handling experienced by the closures during the capping operation.

It is further preferred that the prong be tapered toward the free end which enters the recess in the plug, and that the recess be inwardly tapered. By making the recess taper more than the prong, insertion of the prong into the recess effects the wedging outward of the plug to engage the socket.

The prong preferably has a steeper taper at the free end to aid in alignment during insertion of the plug into the socket. In addition, the plug and the socket are configured to provide an interference fit. In other words, the lateral dimensions of the plug are somewhat larger than the complementary dimensions of the socket. Either or both of the openings in the socket and the free end of the plug are chamfered to aid in insertion of the plug.

In a particularly preferred form, the socket and the plug are elongated laterally and the prong takes the form of an elongated rib. In this case, the prong and the recess are tapered both on the elongated sides and on the ends.

Preferably, a means are provided for holding the moveable section of the lid in the open position for dispensing product through the dispensing orifice. This includes at least one flexible extension on the moveable section of the lid extending beyond the moveable hinge. This at least one extension overlays the upper surface of the raised member on the end wall when the lid is closed. As the lid is rotated about the integral hinge to the open position, the at least one flexible extension slides off the upper surface of the raised member and bears against the side surface of this raised member to hold the lid in the open position. In a most preferred configuration, a pair of flexible extensions are provided on the moveable part of the lid on either side of the hinge. The raised member includes a center section in which the socket is formed and a pair of spaced apart posts which are engaged by the flexible sections of the lid.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
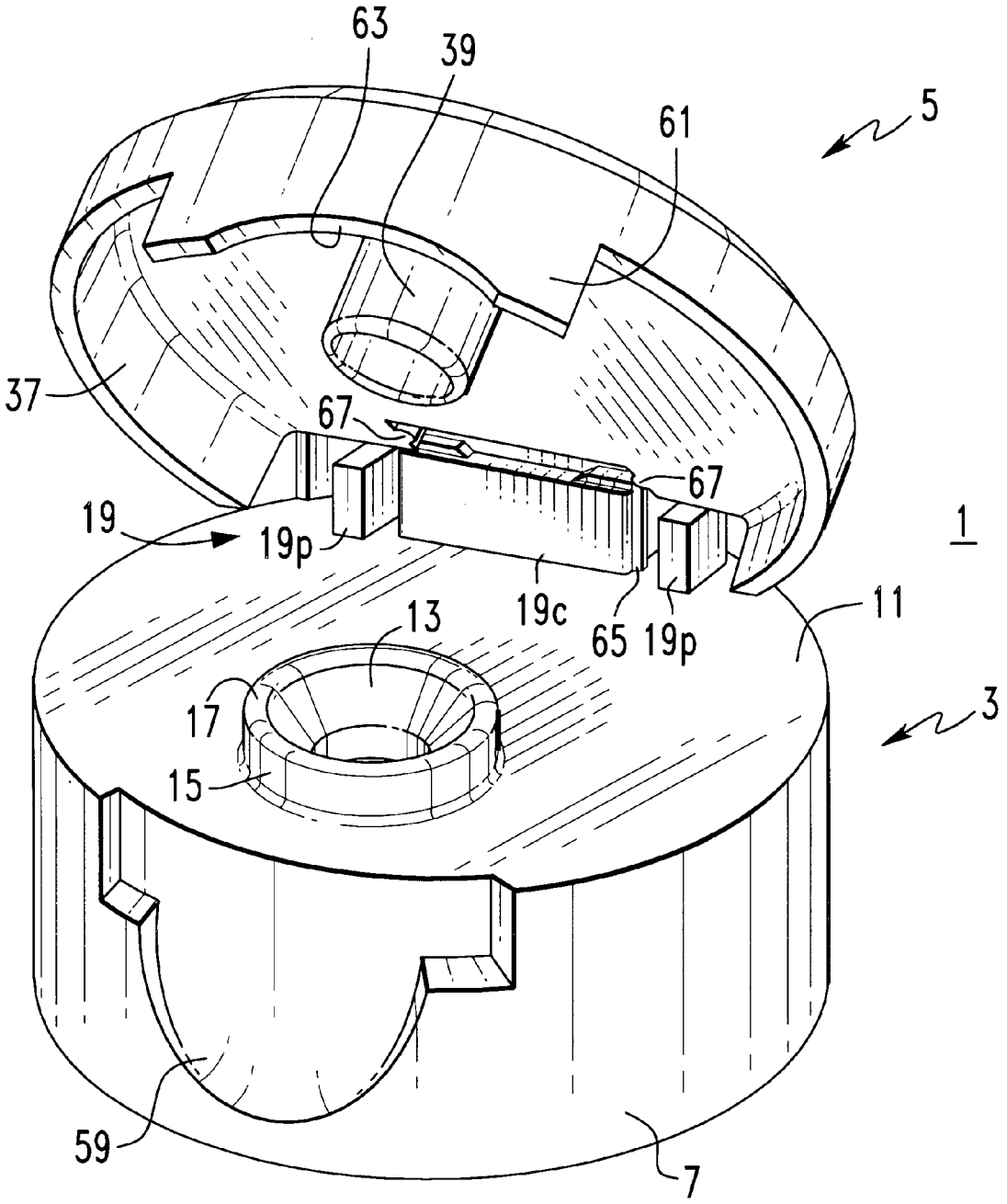
FIG. 1 is an isometric view of an assembled closure in accordance with the invention.
Figure 4:
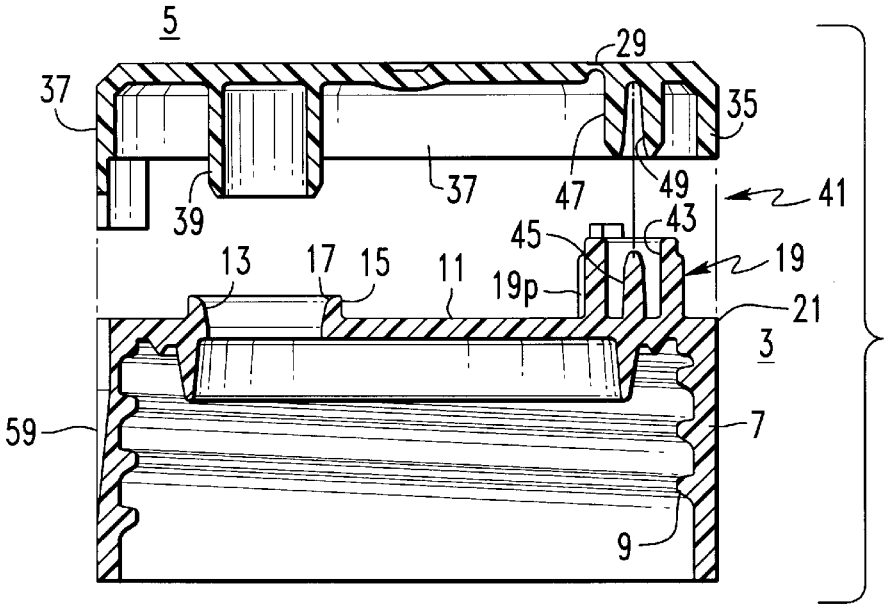
FIG. 4 is a sectional view showing the base and the lid aligned for engagement taken along the lines 4—4 in FIGS. 2 and 3.

As shown in FIG. 1, the closure 1 of the invention includes a base member 3 and a lid 5. The base member includes a cylindrical skirt 7 which is adapted for securing the closure 1 to the neck of a container (not shown). In the embodiment of the invention shown, the skirt 7 is provided with internal threads 9 for this purpose as shown in FIG. 4. Other types of devices for securing the closure 1 to a container can be provided such as a snap on fastener (not shown).

Figure 2:
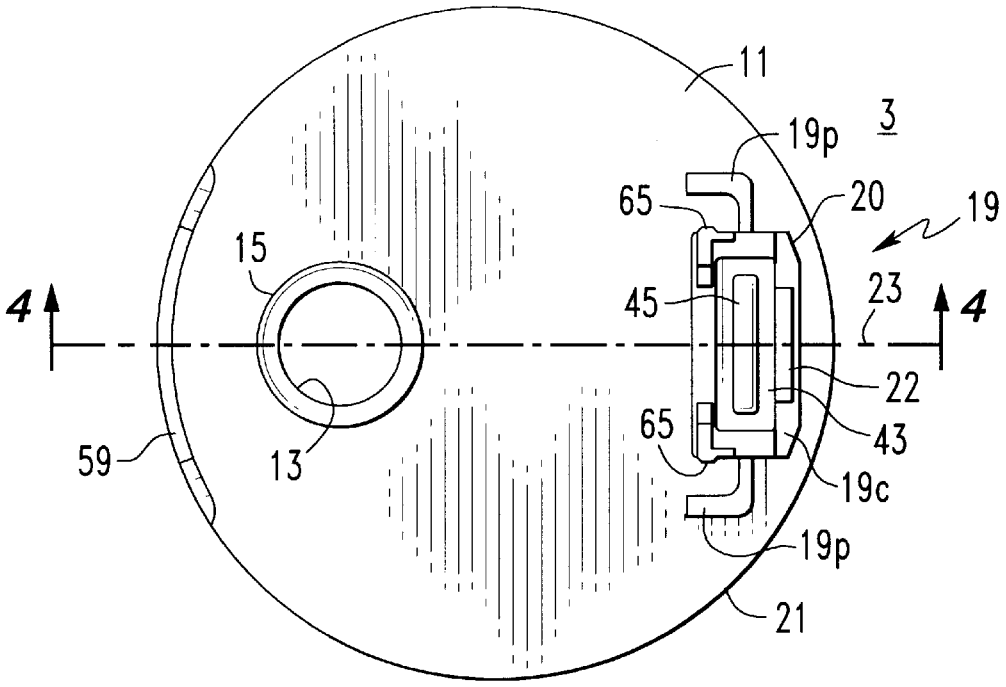
FIG. 2 is a top plan view of the base of the closure of FIG. 1 with the lid removed.

The base member 3 also includes a generally planar end wall 11. An eccentrically positioned dispensing orifice 13 extends through the end wall and is provided with a raised lip 15 which is chamfered at 17 to provide a lead angle for a stopper to be described. A raised member 19 is molded on the end wall 11 adjacent the peripheral edge 21 of the end wall and symmetrically aligned with respect to a diameter 23 passing through the dispensing orifice 13 (see FIG. 2). This raised member 19 includes a center rectangular section 19*c* and a pair of integrally formed posts 19*p* on either side. The posts 19*p* are used for registering the base member during assembly of the closure.

Figure 3:
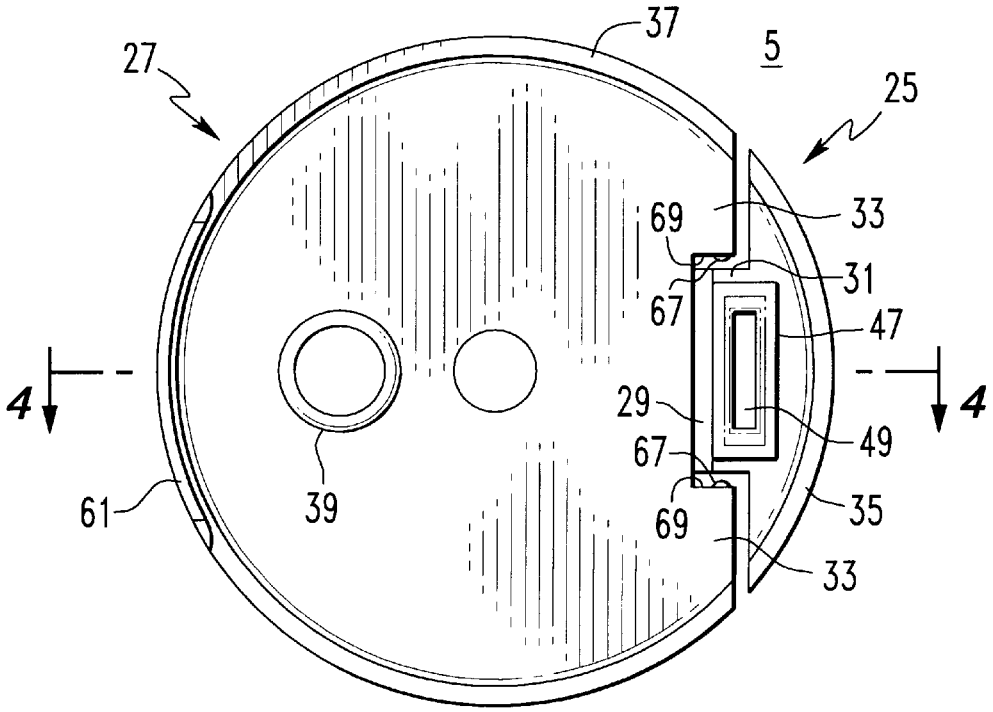
FIG. 3 is an underside view of the lid.
Figure 10:
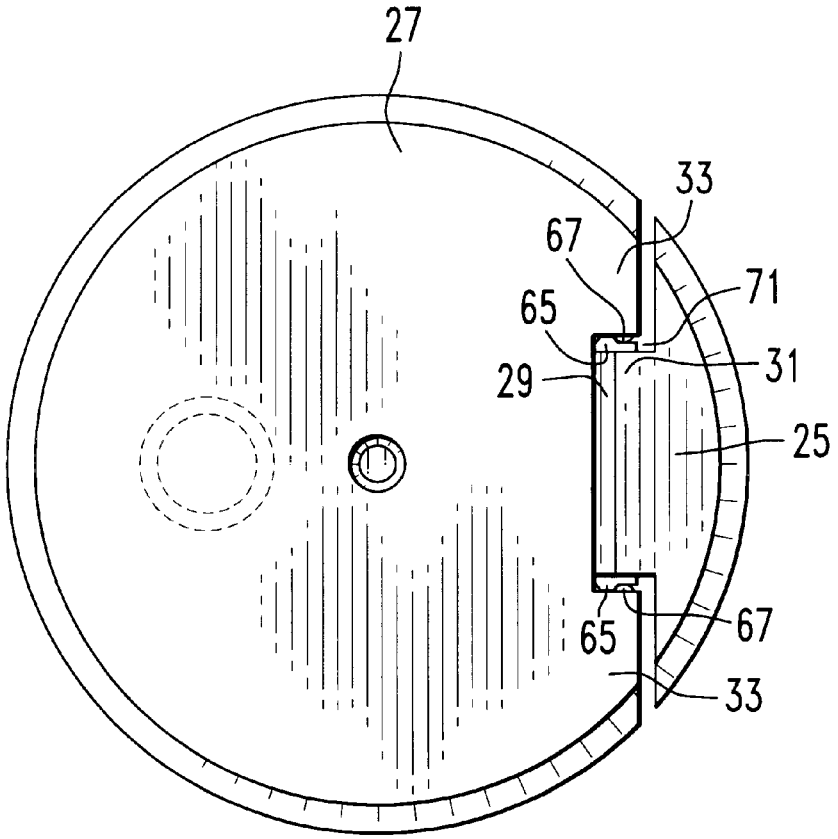
FIG. 10 is the top plan view of the closure with the lid closed.
Figure 11:
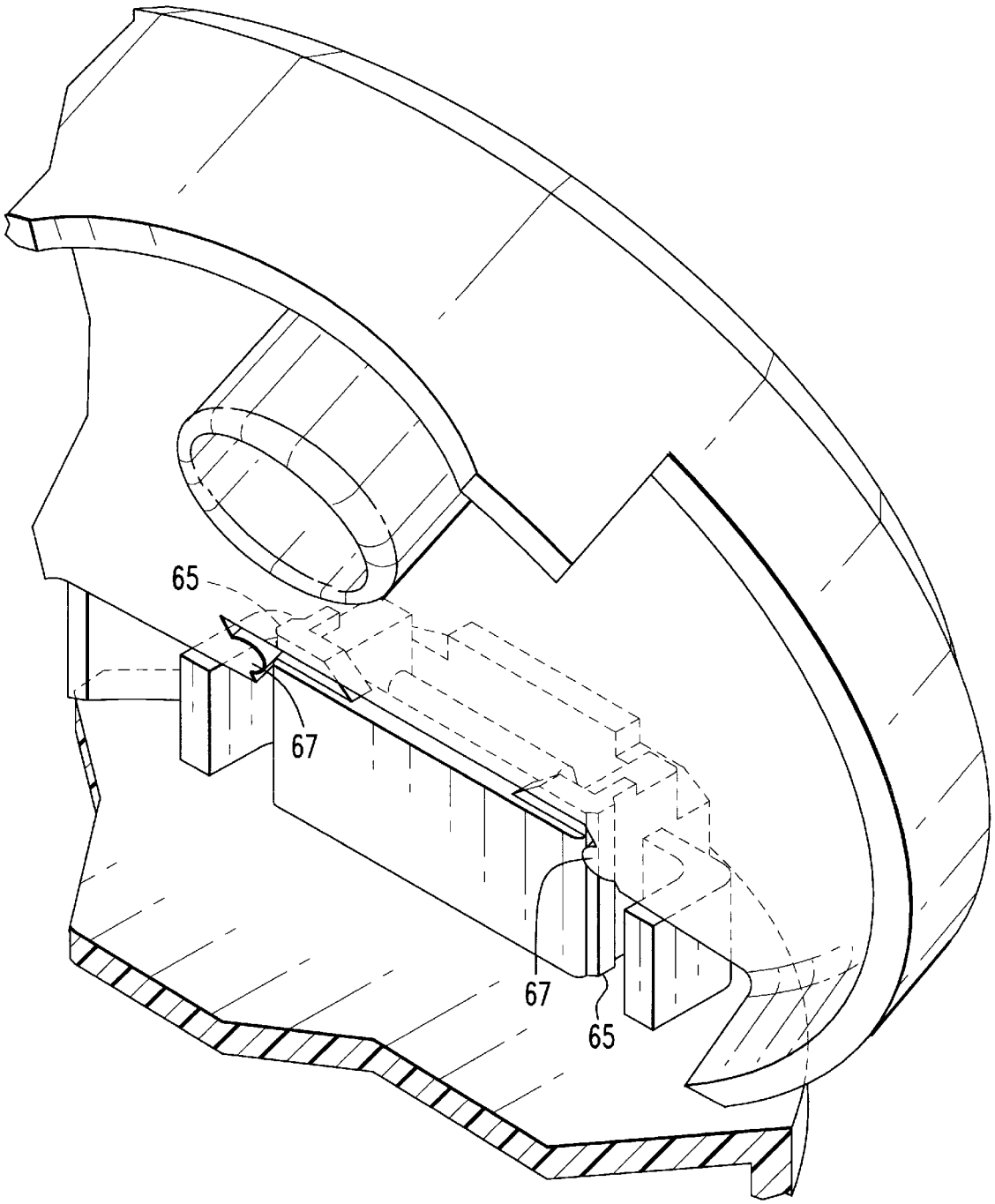
FIG. 11 is a partial isometric view showing the lid retained in the open position.

Turning to FIGS. 3 and 10, the lid 5 has a relatively small fixed section 25 and a relatively large moveable section 27 pivotally joined by an integral hinge 29. The hinge 29 is provided on an extension 31 on the fixed section 25 of the lid which projects into the moveable section. This forms a pair of flexible extensions or wings 33 on the moveable section 27 on either side of the hinge 29. The fixed section 25 and moveable section 27 of the lid 5 are provided with skirts 35 and 37 which form a continuous cylindrical surface when the moveable section 27 is in the same plane as the fixed section 25 (see FIGS. 4 and 11). The moveable section 27 is provided with a stopper 39 which projects downward from the underside. As will be seen, this stopper is aligned for engaging the dispensing orifice 13 in the base member when the lid is closed.

The base member 3 and lid 5 are molded as two separate pieces. They could be molded with a flexible connector between, but even in such case, they are formed as two separate pieces. After the base 3 and lid 5 are molded, they are permanently joined by a mount 41. The mount 41 includes a socket 43 formed in the center section 19*c* of the raised member on the base as shown in FIG. 4 and in detail in FIGS. 5 and 6. This socket is preferably rectangular with a length $l_s$ and a width $w_s$. Centered within the socket 43 is a prong 45, which in the preferred embodiment is formed as an elongated rib.

Figure 7:
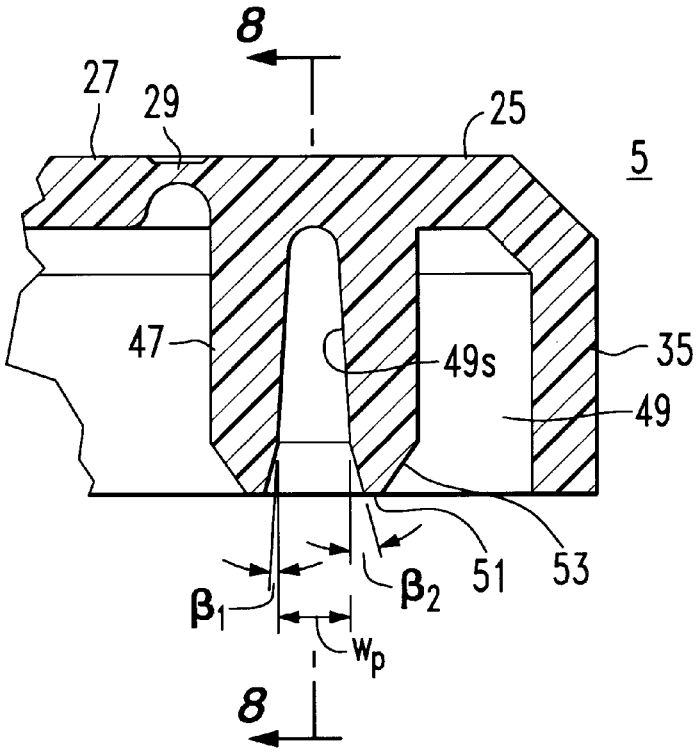
FIG. 7 is an enlarged section of FIG. 4 illustrating details of the plug on the lid.
Figure 8:
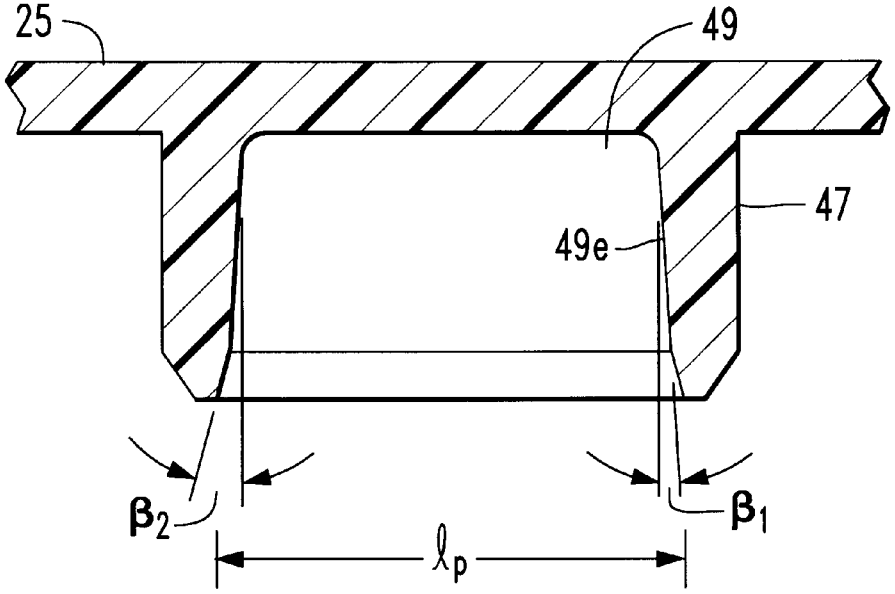
FIG. 8 is a section through the plug taken along the line 8—8 in FIG. 7.
Figure 9:
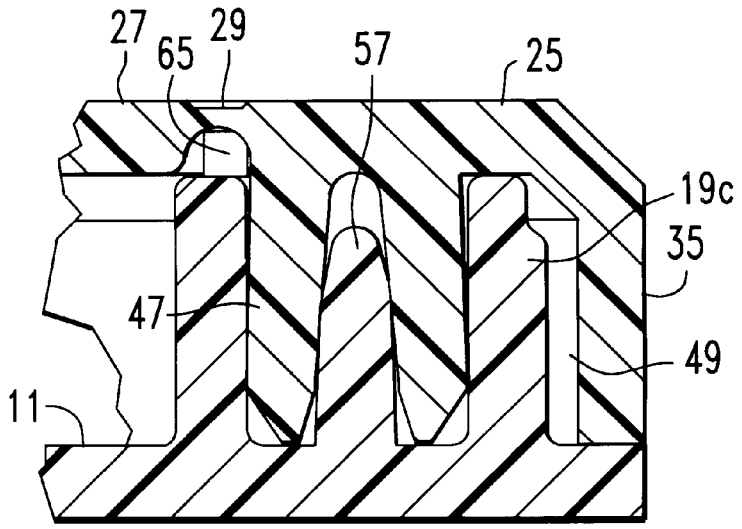
FIG. 9 shows the plug of FIG. 7 engaged with the socket of FIG. 5.

The mount 41 also includes a plug 47 molded into the underside of the fixed section 25 of the lid 5 as shown in FIGS. 4, 7 and 8. In the preferred embodiment of the invention, the plug 47 is also rectangular with a length $l_p$ and a width $w_p$. Centered in the plug is a recess 49 which is laterally elongated in the preferred embodiment.

Figure 5:
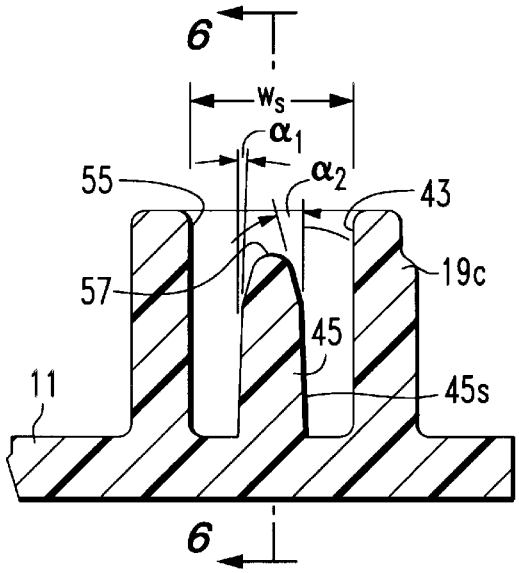
FIG. 5 is an enlarged section of FIG. 4 illustrating details of the socket formed in the base.

An interference fit is provided between the plug 47 and the socket 43 by making the lateral dimensions $l_p$ and $w_p$ of the plug slightly larger, such as by a few thousands of an inch e.g., 0.010, than the corresponding dimensions $l_s$ and $w_s$ of the socket. In order to facilitate engagement of the plug 47 in the socket 43 with this interference fit, the free end 51 of the plug 47 is chamfered 53 about its peripheral edge. In addition to the chamfer 53 on the plug 47, the peripheral edge 55 of the socket could also or, alternatively, be chamfered (not shown). If not chamfered, this edge 55 can be provided with a small radius as shown in FIG. 5.

Figure 6:
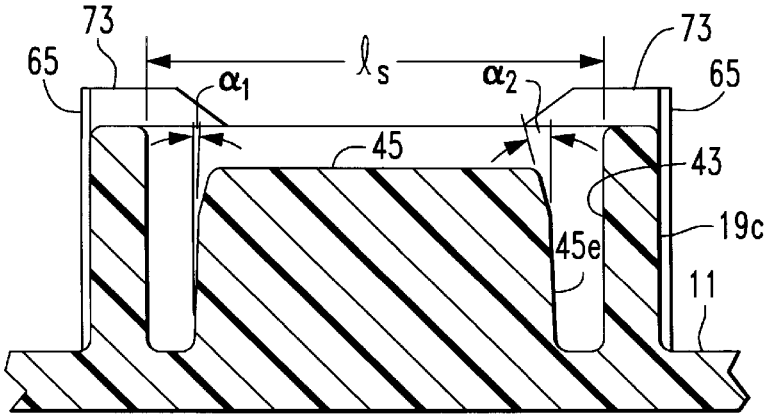
FIG. 6 is a section through the socket taken along the line 6—6 in FIG. 5.

To further provide a secure engagement between the lid 5 and base 3, the prong 45 in the socket 43 is tapered by the angle $\alpha_1$ toward its free end 57. As shown in FIGS. 5 and 6, this prong is tapered by the angle $\alpha_1$ both on its side surfaces 45*s* and end surfaces 45*e*. Adjacent the free end 57, the prong is further tapered by the angle $\alpha_2$. Again, this additional taper is provided on both the side surfaces 45*s* and end surfaces 45*e*.

As seen in FIG. 7, the recess 49 in the plug 47 is also tapered inwardly at an angle $\beta_1$. Adjacent the opening, the recess 49 is tapered further by an angle $\beta_2$. These tapers $\beta_1$, and $\beta_2$ in the recess are provided on the sides 49*s* and the ends 49*e* of the recess. The length $l_p$ and the width $w_p$ of the prong are somewhat smaller than the corresponding dimensions $l_r$ and $w_r$ of the recess so that initially the prong easily enters the recess. However, as the taper $\beta_1$ of the recess is greater than the taper $\alpha_1$ of the prong, an interference fit develops between the prong and the recess which wedges the plug outward into tight engagement within the socket. The base 3 and lid 5 are molded of a resin such as polypropolene, polyethylene and other thermoplastic resins. Such resins have an elasticity which provides a tight fit between the socket and plug. In the exemplary embodiment of the invention, the taper angle $\alpha_1$ is about 2° and angle $\beta_1$ is about 3.5°. The angles $\alpha_2$ and $\beta_2$ are each about 15° and the chamfer 53 is about 35°.

As can be appreciated from FIG. 4, when the lid is closed, the moveable section 27 of the lid 5 overlays the end wall 11 with the stopper 39 engaged in the dispensing orifice 13. In this closed position, the skirt 35 on the fixed section of the lid and the skirt 27 on the moveable section 27 of the lid form a continuous, cylindrical surface with the skirt 7 on the base. In order to assist in opening the lid, a thumb recess 59 is provided in the skirt 7 of the base in alignment with the diameter 23. An extension 61 projects downwardly from the skirt 37 on the moveable section 27 of the lid over the thumb recess 59. This extension 61 has a lower surface 63 which is curved for engagement by the thumb nail of a user to flip the moveable section 27 of the lid open.

In order to provide clearance for the skirt 35 on the fixed section 25 of the lid, the rear corners of the raised member 19*c* are chamfered at 20. Additional clearance is provided by thinning and shortening the top edge of the rear wall of the raised member 19*c* to form a rib 22.

In order to retain the movable section 27 of the lid 5 in the open position, first projections in the form of chamfered vertical ribs 65 are molded onto the sides of the raised member 19*c*. Second projections in the form of knobs or buttons 67 having cylindrical surfaces are molded on the inner edges 69 of the wings or extensions 33 of the moveable section 27 of the lid 5 confronting the sides of raised member 19*c*. The ribs 65 and the knobs 67 project toward one another in overlapping relation in the gaps 71 between the wings 33 and the raised member 19*c*. As the movable section 27 of the lid 5 is raised, the wings 33 pivot and the knobs 67 engage the ribs 65. Due to the elasticity of the resin from which the parts are molded, the parts elastically distort and the knobs pass in front of the ribs. Thus, the knobs 67 and ribs 65 form cooperating members which retain the lid in the open position even as the container is inverted and shaken to dispense its contents.

As shown, the ribs 65 extend upward above the top of the raised member 19*c*, so that even if the plug 47 is not fully seated in the socket 43, the ribs 65 and knobs 67 will still engage when the lid 5 is opened. Molded extensions 73 on top of the raised member 19*c* backup the ribs 65 and give them strength.

While specific embodiments of the invention have been described in detail, it will be appreciated by those skilled in the art that various modifications and alternatives to those details could be developed in light of the overall teachings of the disclosure. Accordingly, the particular arrangement disclosed are meant to be illustrative only and not limiting as to the scope of invention which is to be given the full breath of the claims appended and any and all equivalents thereof.

What is claimed is:

1. A closure for mounting on a container neck and comprising:

a base member having a cylindrical skirt with means for securing said base member to said container neck, and an end wall having a dispensing orifice extending therethrough;

a lid having a fixed section and a moveable section joined by an integral hinge, said moveable section having a stopper for engaging and closing said dispensing orifice; and mounting means for mounting said lid on said base member with said moveable section moveable about said integral hinge between a closed position in which said moveable section overlays said base member with said stopper engaging and closing said dispensing orifice and an open position in which said moveable section is rotated clear of said end wall and said stopper is disengaged from said dispensing orifice, said mounting means comprising a socket in one of said base member and said fixed section of said lid, said socket having a prong therein, said mounting means further including a plug in the other of said base member and said fixed section of said lid configured to be received in said socket and having a recess engaged by said prong, said prong and recess being configured to wedge said plug outward into engagement with said socket.

2. The closure of claim 1 wherein said prong is tapered toward a free end which enters said recess in said plug and said recess is inwardly tapered.

3. The closure of claim 2 wherein said recess is tapered more than said prong.

4. The closure of claim 3 wherein said end wall of said base member has a raised member spaced from said dispensing opening and said socket is formed in said raised member.

5. The closure of claim 4 wherein said prong is tapered at about 2 degrees, and said recess is tapered at about 3½ degrees.

6. The closure of claim 3 wherein said prong is further tapered adjacent said free end greater than said recess.

7. The closure of claim 6 wherein at least one of a peripheral edge at a free end of said plug and an edge at an opening of said socket is chamfered.

8. The closure of claim 7 wherein said socket and plug are dimensioned to produce an interference fit between said socket and plug.

9. The closure of claim 6 wherein said socket and said prong in said socket are laterally elongated and said plug and said recess in said plug are similarly laterally elongated.

10. The closure of claim 9 wherein said prong is an elongated rib having side and end surfaces, each of which is tapered toward a free edge of said rib, and said recess having side and end surfaces, each of which is tapered inwardly more than said side and end surfaces of said rib.

11. The closure of claim 10 wherein said socket and said plug are dimensioned to produce an interference fit between said socket and plug and wherein at least one of a peripheral edge at a free end of said plug and a free edge at an opening of said socket is chamfered.

12. The closure of claim 11 wherein said end wall of said base member has a raised member spaced from said dispensing opening and said socket is formed in said raised member.

13. The closure of claim 1 wherein said fixed section of said lid has an extension which projects into said movable section and forms said integral hinge with said moveable section of said lid and which also forms at least one wing on said moveable section of the lid projecting beyond said hinge, said end wall of said base member having a raised member spaced from said dispensing orifice on which said mounting means mounts said fixed section of said lid, and said mounting means further including means holding said movable section of said lid in said open position and comprising cooperating members on at least one side of said raised member and on a confronting edge of a corresponding at least one of said wings which engage as said movable section of said lid is moved to said open position.

14. The closure of claim 13 wherein said cooperating members include a first projection on said at least one side of said raised member projecting toward said at least one wing and a second projection on said confronting edge of said at least one corresponding wing projecting toward said raised member and overlapping said first projection.

15. The closure of claim 14 wherein said first projection comprises an integral rib on said at least one side of said raised member and said second projection comprises a knob on said confronting edge of said at least one corresponding wing.

16. The closure of claim 15 wherein said socket is formed in an upper surface of said raised member and said plug is formed in a bottom surface of said fixed section of said lid and wherein said rib extends above said raised member to ensure engagement of said first and second projections even if said plug is not fully seated in said socket.

17. A closure for mounting on a container neck and comprising:

a base member having a cylindrical skirt with means for securing said base member to said container neck, an end wall having a dispensing orifice extending therethrough, and a raised member spaced from said dispensing orifice;

a lid having a moveable section and a fixed section having an extension which projects into said moveable section and forms an integral hinge therewith and which also forms at least one wing on said moveable section of said lid projecting beyond said hinge, said moveable section having a stopper for engaging and closing said dispensing orifice, and mounting means for mounting said lid on said raised member of said base member with said moveable section moveable about said integral hinge between a closed position in which said moveable section overlays said base member with said stopper engaging and closing said dispensing orifice and an open position in which said moveable section is rotated clear of said end wall and said stopper is disengaged from said dispensing orifice, said mounting means further comprising means holding said movable section of said lid in said open position and comprising cooperating members on at least one side of said raised member and on a confronting edge of a corresponding at least one of said wings which engage as said movable section of said lid is moved to said open position.

18. The closure of claim 17 wherein said cooperating members include a first projection on said at least one side of said raised member projecting toward said at least one wing and a second projection on said confronting edge of said at least one corresponding wing projecting toward said raised member and overlapping said first projection.

19. The closure of claim 18 wherein said first projection comprises an integral rib on said at least one side of said raised member and said second projection comprises a knob on said confronting edge of said at least one corresponding wing.

* * * * *